United States Patent [19]

Saunders

[11] Patent Number: 4,669,629

[45] Date of Patent: Jun. 2, 1987

[54] FULL-OPEN CONVENIENCE-FEATURE SHEET METAL CAN

[75] Inventor: William T. Saunders, Weirton, W. Va.

[73] Assignee: Weirton Steel Corporation, Weirton, W. Va.

[21] Appl. No.: 854,914

[22] Filed: Apr. 23, 1986

[51] Int. Cl.[4] ..... B65D 17/34

[52] U.S. Cl. ..... 220/273; 220/90.6

[58] Field of Search ..... 220/269–273, 220/90.6

[56] References Cited

U.S. PATENT DOCUMENTS 3,251,502 5/1966 Hayford ..... 220/273

3,762,596 10/1973 Henning et al. ..... 220/273

*Primary Examiner*—George T. Hall

*Attorney, Agent, or Firm*—Raymond N. Baker

[57] ABSTRACT

One-piece sheet metal can body and end closure structure for assembly of a two-piece can with full-panel convenience feature and protection for residual scoreline metal edge after opening; a tamper-proof non-breakable container with full access for various types of food is provided. A stepped-flange rim on the can body and a U-shaped groove in the end panel, for submerging the scoreline, shield severed edge metal.

9 Claims, 14 Drawing Figures

FIG. 3
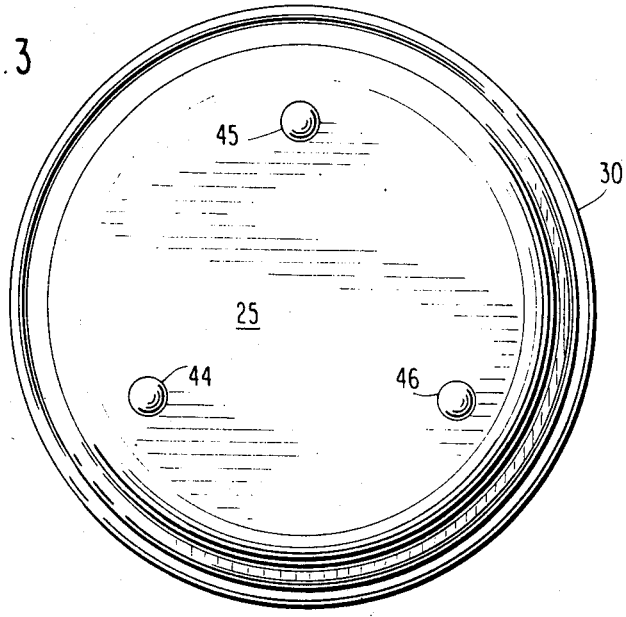
FIG. 4
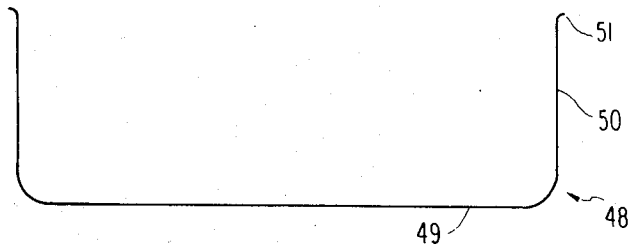
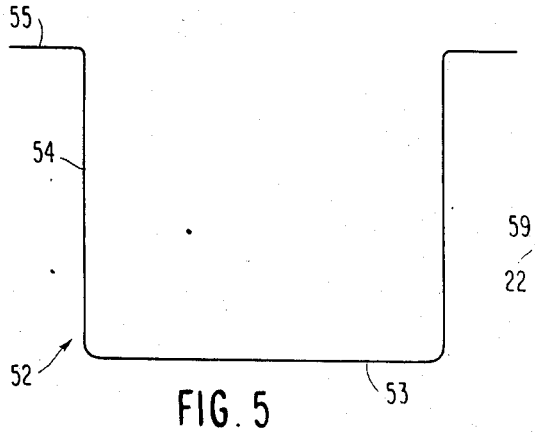
FIG. 5
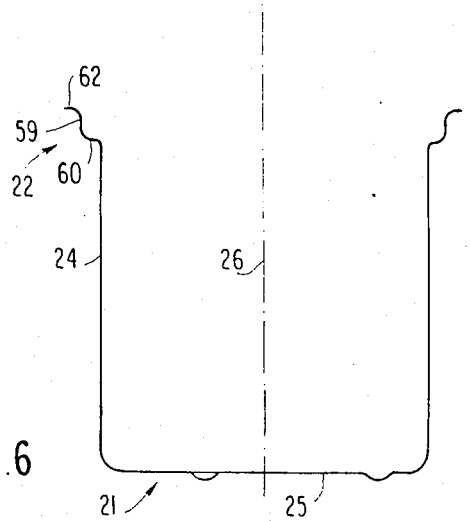
FIG. 6

FIG. 10
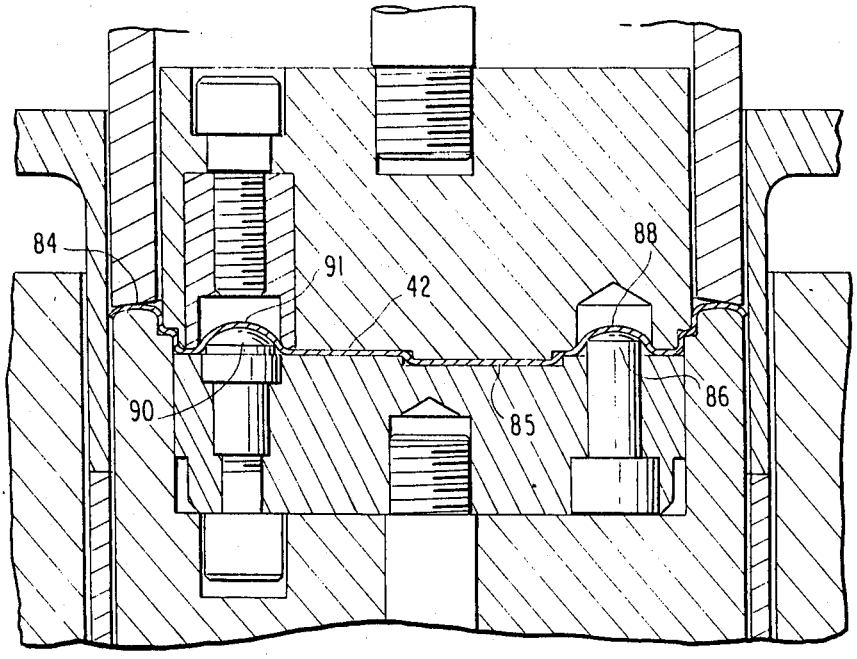
FIG. 11
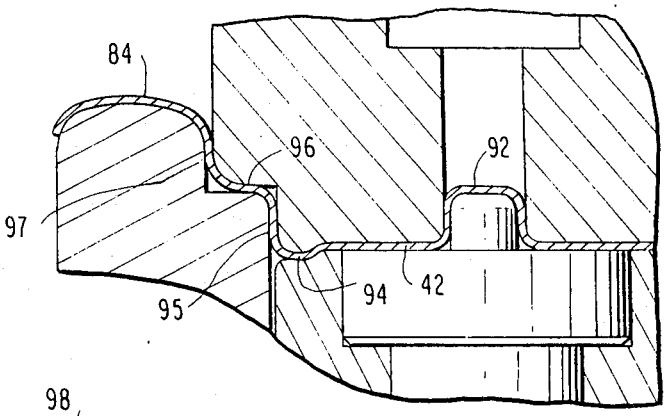
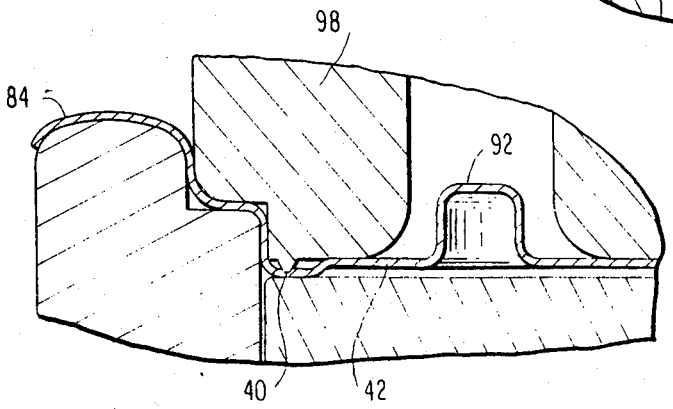
FIG. 12

FULL-OPEN CONVENIENCE-FEATURE SHEET METAL CAN

This invention is concerned with one-piece sheet metal can bodies, closure structures for two-piece sheet metal cans, convenience features with severed edge metal protection and corresponding fabrication methods.

A typical application for the contributions of the invention would be baby food containers. Sheet metal threaded caps have been widely and advantageously used with glass jars in the manufacture of such containers. Several desirable features for baby food containers have presented problems of long standing which tended to block further use of sheet metal in the manufacture of such containers. However, significant improvements in fabricating methods and structural features as taught herein enable sheet metal usage throughout such containers while providing the access required for the different types of baby foods, and desired easy-open features.

As part of the present invention, measures capable of providing desired versatility in handling semi-fluid to semi-solid contents were analyzed along with prior art problems and limitations on convenience features. As a result of the concepts devised, a tamper-proof, rigid, non-breakable, long shelf-life storage container for foods is provided along with full-panel pull-out convenience features for ready access to and removal of semi-solid foods, stable stacking provisions for sealed cans, and severed metal edge protection features after opening. These features are provided economically while eliminating disadvantages which have been associated with the side wall seam of a three-piece can.

In describing concepts, fabricating methods, structural features and further contributions of the invention, reference is made to the accompanying drawings, in which:

FIG. 3 is a bottom plan view of the embodiment of FIG. 1;

FIGS. 4, 5 and 6 are schematic, cross-sectional sequential views of cup-shaped work product during fabrication of a one-piece can body embodying the invention;

FIG. 10 is a cross-sectional view showing a portion of the tooling and an end closure structure work product during an initial forming operation, in accordance with the invention, in which a recessed end wall panel is formed in a flat-rolled sheet metal blank, flange metal is presented, unitary rivet button formation is initiated and support protrusions in the end wall panel are being formed;

FIG. 11 is a cross-sectional view of a portion of the tooling and the closure structure work product during an operation subsequent to that of FIG. 12 in which the rivet button is being further shaped and an inwardly directed U-shaped trough is being formed around the periphery of the recessed end wall panel;

FIG. 12 is a cross-sectional assembly view showing a portion of the tooling and the closure structure work product in an operation subsequent to that of FIG. 11, and prior to attachment of an integral tab opener, in which the sheet metal is being scored within the U-shaped trough of FIG. 11;

Figure 13:
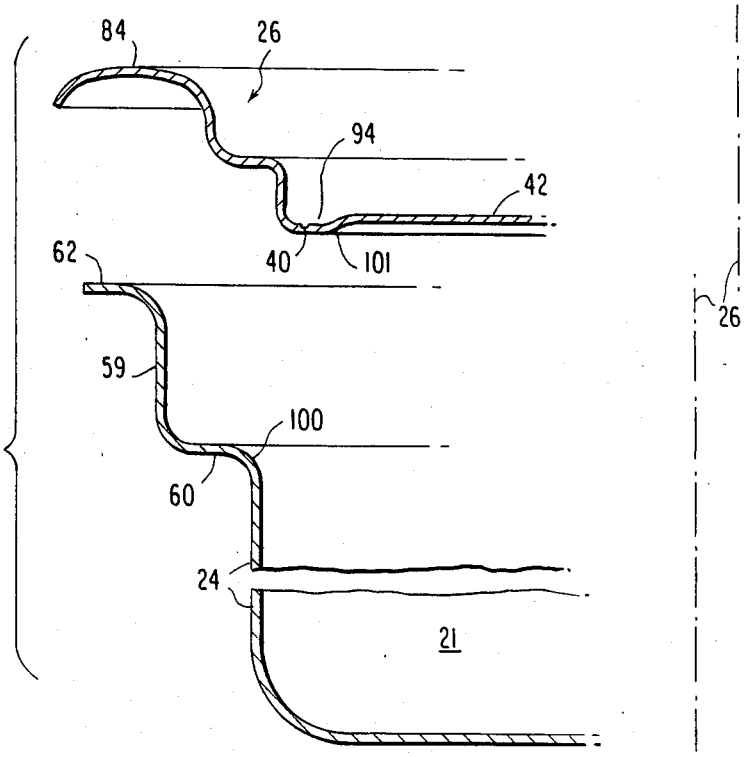
Figure 14:
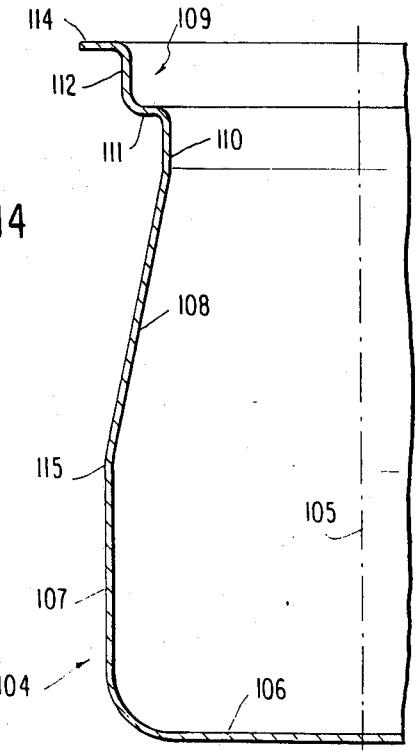

FIG. 13 is a cross-sectional schematic view of a portion of a can body and a portion of a closure structure embodying the invention, shown in juxtaposition for movement into place for forming a chime seam; and FIG. 14 is a schematic partial view, in cross section, of a can body embodiment capable of assembly with the end closure structure of the invention such that the outer diameter of the chime seam is equal to that of the main body side wall portion.

Figure 1:
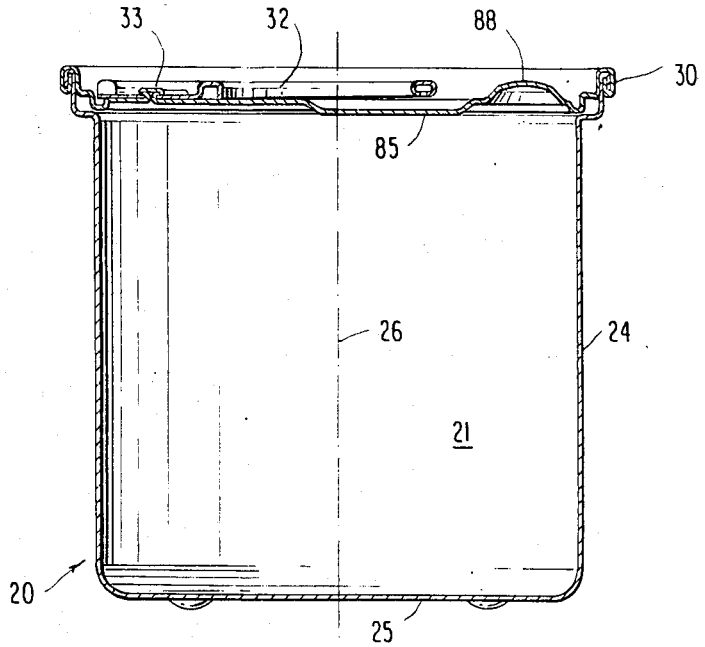
FIG. 1 is a cross-sectional view of a sheet metal can embodying the invention.

That the assembled sheet metal can 20 of FIG. 1 utilizes a cup-shaped can body 21 which is free of seams is an important contribution considering the convenience and safety features made available by the invention. Portions of this can body, such as its unitary end wall and side wall, can be formed by draw-redraw techniques as disclosed in copending U.S. application Ser. No. 712,238, filed Mar. 15, 1985, entitled "Drawn Can Body Methods, Apparatus and Products" (which is included herein by reference). However, in addition, a stepped-flange rim 22 (FIG. 6) is formed at its open end.

Stepped-flange rim 22, side wall 24 and bottom end wall 25 are unitary and each is symmetrically located with respect to central longitudinal axis 26.

A significant contribution to the food container art is the provision of a convenience-feature opening having a diameter at least equal to that of the side wall main body. This facilitates removal of non-pourable contents (for example semi-solid comestibles) while combining easy-open and edge protection features.

In the embodiment of FIG. 1, the main body portion of the side wall is of uniform diameter throughout the height from unitary end wall 25 to stepped-flange rim 22.

Figure 2:
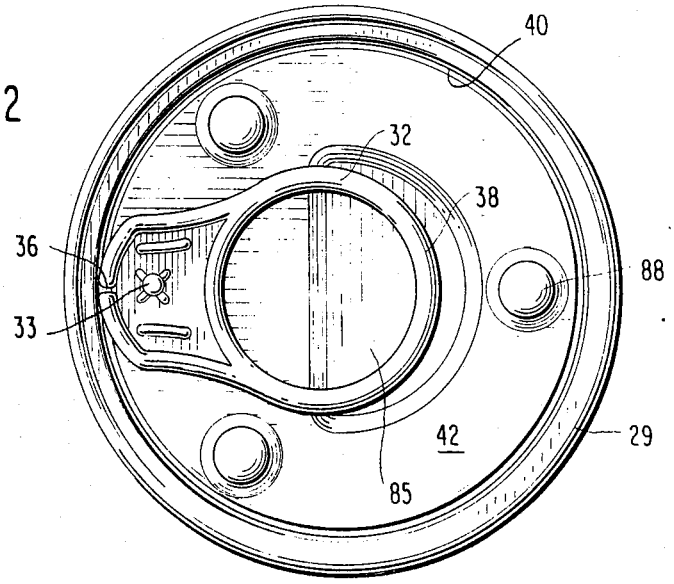
FIG. 2 is a top plan view of end closure structure embodying the invention.

The closure structure 28 of FIG. 2 presents peripheral flange metal 29 which is joined with peripheral flange metal of can body 21 to form a chime seam 30 (FIG. 1); conventional double-seam chime practice can be utilized.

An elongated tab opener 32 (FIGS. 1 and 2), made integral with closure structure 26, by means such as unitary rivet 33, is oriented diametrically of the cylindrical can; working end 36, longitudinally opposite to handle end 38, is positioned contiguous to a scoreline to be ruptured. (Methods for fabricating a sheet metal rivet button and securing an opener to a closure structure with a unitary rivet are known in the art so as not to require detailed explanation for purposes of understanding concepts of the present invention.)

The sheet metal of the closure structure is scored in a continuous line. Resulting scoreline 40 is located radially inwardly of, but contiguous to, the closure structure flange metal 29 and the resultant can chime seam 30. The reduced sheet metal thickness scoreline 40 is strategically positioned for providing the desired opening and, for safety purposes after opening.

After opening, the severed edge of scoreline residual metal of that minor portion of original end wall panel 42 which remains with the can body is shielded. That is, user protection is provided should a consumer accidentally insert a finger into the opened end of the can.

Such protection is provided by scoreline placement and disposition, in coordination with a can body configuration which inhibits cutting contact with such severed edge of the residual metal of the scoreline; thus, accidental cutting is substantially precluded by multiple concepts which are shown and explained in more detail in relation to later figures.

At the opposite end of the can body, unitary bottom wall 25 is substantially planar (as shown in cross section in FIG. 1) except for nodules such as 44, 45, 46 of FIG. 3. These nodules extend externally in relation to the cup-shaped can body 21 beyond the transverse plane of the main panel of end wall 25. The important function of such nodules is to support a can, on end, in slightly spaced relationship from a heating surface, e.g., when a baby food can is placed, open end up, in a pan of water resting on a burner for purposes of heating the contents of the can. Nodules 44, 45, 46 are oriented in a tripod arrangement in FIG. 3 but other arrangements, with additional nodules positioned for stable support, can be utilized.

The cup-shaped configuration, per se, of can body 21 is formed by draw-redraw practice with special stepped-flange tooling and bottom nodule tooling being utilized as final redraw is being completed.

Initially, a circular blank of predetermined diameter is cut from flat-rolled sheet metal coated with an organic coating on both its planar surfaces. Such cut blank is formed into cup 48 (FIG. 4) having end wall 49, side wall 50 and flange metal 51, at the open end of the cup, extending radially outwardly in transverse relationship to the central longitudinal axis. In forming a baby food can, cup 48 has an internal diameter of about 3.5", a side wall height of about 1.27", a radius between end wall 49 and side wall 50 of about 0.2", and a radius between the side wall and flange metal of about 0.04".

In the illustrated embodiment, which uses a double redraw, cup 48 is then redrawn into redrawn cup 52, shown in FIG. 5, presenting a decreased diameter end wall 53, increased-height side wall 54 and flange metal 55 at the open end of the redrawn cup. Flange metal 55 extends radially outwardly in transverse relationship to the center longitudinal axis of the cup. In forming a baby food can, work product 52 has a diameter of about 2.4", a side wall height of about 2.0", a radius between bottom wall 53 and side wall 54 of about 0.07" and a radius between the side wall 54 and flange metal 55 of about 0.04".

Final can body 21 is formed by redrawing the cup 52 of FIG. 5 to further decrease its diameter, to that shown for end wall 25 and side wall main body 24 (FIG. 1), and to elongate the side wall of cup 52.

As redrawing of cup 21 is being completed, the stepped-flange rim 22 is formed utilizing a portion of the side wall metal and the flange metal of the previous work product cup 52.

For example, in the stepped-flange rim 22 of FIG. 6, the diameter of wall portion 59 was the diameter of side wall 54 of cup 52 of FIG. 5. Ledge 60, which lies in a plane substantially transversely perpendicular to central longitudinal axis 26 and is toroidal in plan view, is formed by interrupting the second redraw before reaching the open end of the can body; the diametric dimension of ledge 60 comprises the reduction in diameter during such final redraw. Seam flange metal 62, at the longitudinal end of the can body 21 and at the periphery of rim 22, comprises a portion of flange metal 55 from the work product 52 of FIG. 5, after trimming.

In forming stepped-flange rim 22, the final redraw stroke is interrupted so that neither the metal of side wall portion 59, nor flange metal 62, are re-formed during final redraw.

In forming a baby food can, the diameter of the main body side wall 24 of FIG. 6 has an internal diameter of about $2\frac{1}{8}$"; the radius between end wall 25 and side wall 24 is about $\frac{1}{8}$", the internal diameter of rim side wall portion 59 is about 2.4", the ledge 60 has a radial dimension (one side of the can body) of about 0.17", the radius between side wall 24 and ledge 60 is about 0.03", the radius between wall portion 59 and flange 62 is about 0.07".

As shown in FIG. 6, flange metal 62 has been trimmed to be of uniform diameter utilizing commercially available flange trimming apparatus, preferably of the type described in U.S. Pat. No. 4,404,836 of Sept. 20, 1983, entitled "Metal Container Edge Trimming Method and Apparatus".

Figure 7:
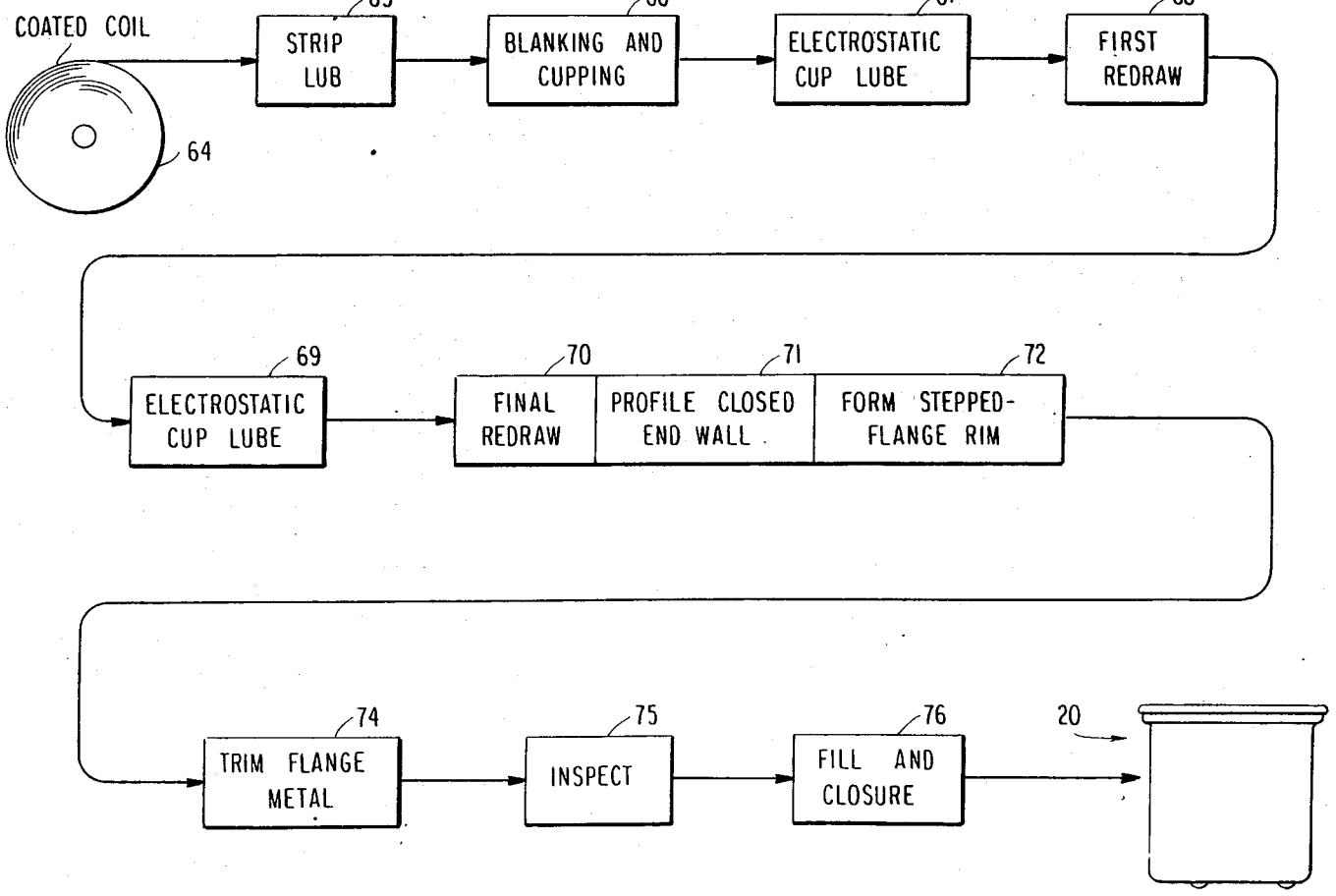
FIG. 7 is a schematic diagram for describing steps carried out in fabricating work product as shown in FIGS. 4, 5 and 6 and assembling the two-piece can of the invention.

Referring to FIG. 7, in forming a unitary can body, in accordance with the invention, continuous strip coated with organic coating on both its surfaces from coil 64 is lubricated as coiled or at lube station 65. A circular blank of predetermined diameter is cut from the sheet metal and drawn at cupping and blanking station 66 into the cup-shaped work product with flange metal shown in FIG. 4.

The cup with flange metal is lubricated on both its surfaces with an FDA-approved lubricant at cup lube station 67 using apparatus as disclosed in copending U.S. application Ser. No. 681,630, filed Dec. 14, 1984, entitled "Electrostatic Lubrication of Cup-Shaped Can Bodies". The lubricated cup is then drawn at first redraw station 68 into the work product shown in FIG. 5, relubricated on both surfaces at station 69 and transferred to the final redraw station 70. As indicated at 71, profiling of the closed end wall providing, for example, nodules 44, 45, 46, can be completed utilizing a portion of the stroke of the final redraw apparatus. The stepped-flange rim 22 of FIG. 6 can also be formed utilizing such final redraw apparatus as indicated by 72.

At station 74 flange metal is trimmed and the can body is inspected at station 75. Filling and closure can be completed at station 76 for delivery of assembled can 20.

Figure 8:
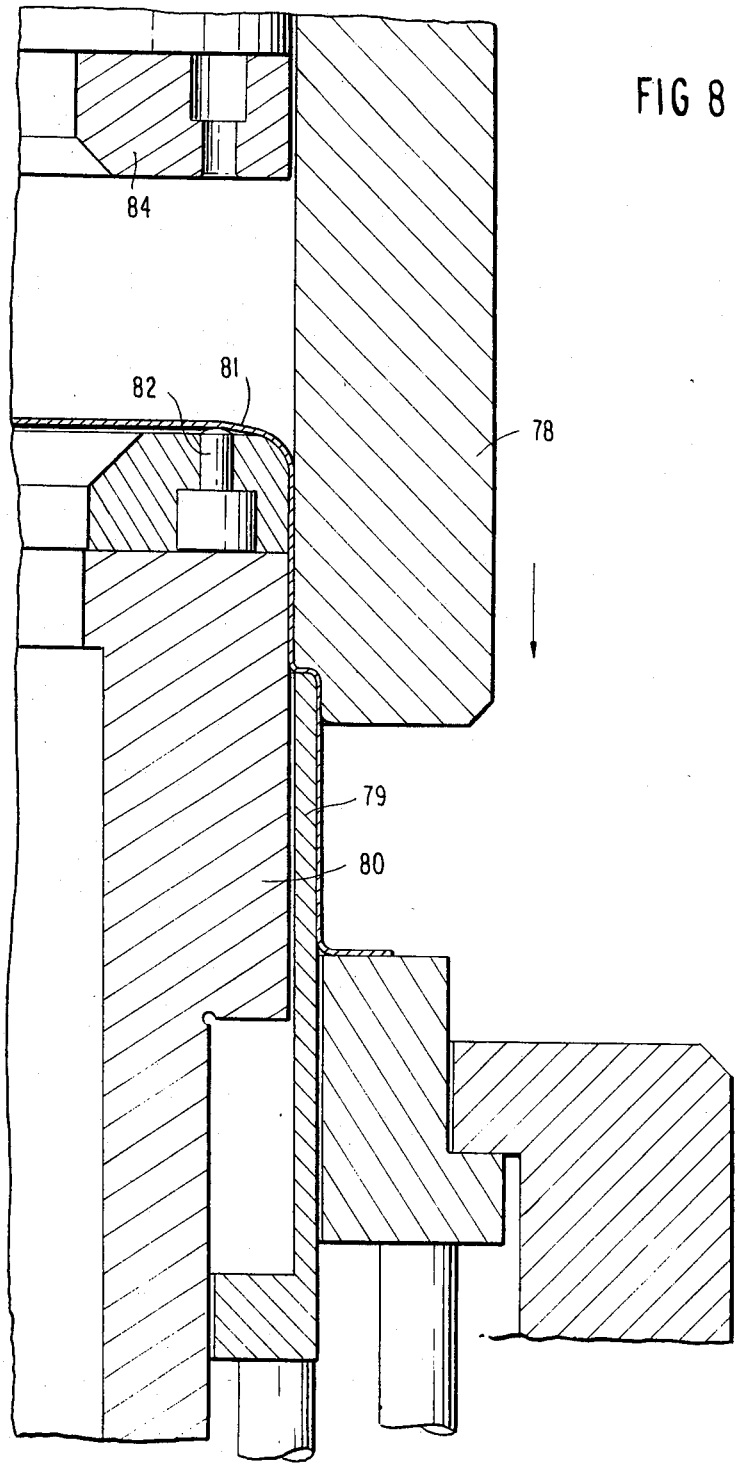
FIG. 8 is a cross-sectional view showing a portion of the tooling and a cup-shaped work product during fabrication of a can body embodying the invention.

FIG. 8 is a partial view at the final redraw station as the diameter of the work product is being reduced by relative movement between draw die 78, draw ring 79, and draw punch 80 as indicated. The sheet metal at 81 is draped across nodule-forming pins, such as 82, which move with draw punch 80.

Figure 9:
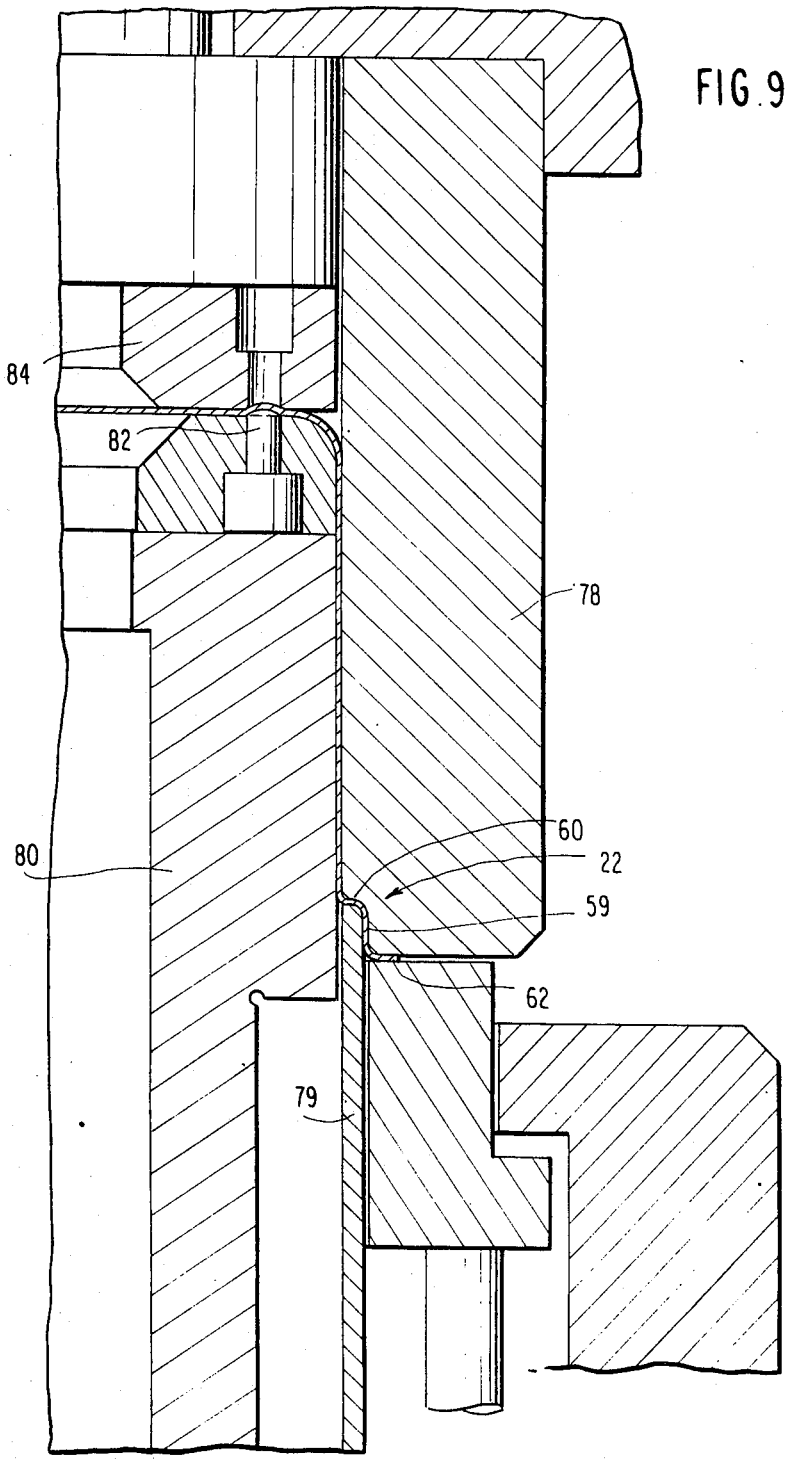
FIG. 9 is a cross-sectional view showing a portion of the tooling and the cup-shaped work product, sequential to FIG. 8, upon completing fabrication of the can body of FIG. 6.

Subsequent to FIG. 8, as shown in FIG. 9, the bottom profiling is completed by contact of draw punch 80 with end wall die 84; and, the stepped-flange rim 22 is formed, as shown, by interrupting the redraw before reaching the open end of the can body. The side wall portion 59 of the stepped-flange rim 22 comprises, as mentioned, a portion of the side wall of the previous work product; the ledge 60 shown comprises the reduction in diameter of the final redraw, and flange 62 is part of the flange metal from the previous work product. Side wall portion 59 and flange metal 62 are not redrawn in the final redraw operation but, rather, the draw die and draw ring 79 are contoured to the desired stepped-flange rim configuration.

FIGS. 10, 11 and 12 are partial views from shop assembly type drawings showing portions of tooling and work product during forming of a closure structure in accordance with the invention.

A flat-rolled sheet metal blank of circular configuration and predetermined diameter is cut from sheet or strip material. The blank is initially forced, as shown in FIG. 10, to present a generally planar end wall panel 42 recessed longitudinally from peripheral flange 84. Finger indentation 85 is also impressed in end wall panel 42.

In this first forming operation, tooling 86 impresses externally directed protrusion 88 as tooling 90 starts formation of a button contour 91 for unitary rivet 33. In two sequential steps, not illustrated, such initial contour for a rivet button is progressively shaped in a manner known in the art.

Rivet button 92 is completed in the step represented by FIG. 11. In this step, a trough 94 of U-shaped configuration (in radial cross section) is formed about the periphery of end wall panel; such trough extends in the axial direction, protruding on the can interior surface of the closure structure. Trough 94 is recessed in relation to the can exterior surface of panel 42 and is located between panel 42 and closure wall portion 95; ledge 96 and wall portion 97 extend to flange metal 84.

FIG. 12 shows scoring tool 98 forming scoreline 40 in the bottom of trough 94. The scoreline 40 is continuous, extending around the length of the trough which circumscribes panel 42. Rivet button 92 is ready for the next operation in which an elongated opener is placed over such button and the unitary rivet 33 is formed in accordance with known methods.

The end closure 26 of FIG. 12 has a diameter of about 2.75" dependent on the length of flange metal 84 with the midpoint of flange metal for chime seam purposes being about 2.6". Trough 94 has a depth between about 0.03" to 0.05" (relative to panel 42) and width of 0.1" (in radial cross section). Trough wall portion 95 has a height of about 0.085", ledge 96 a radial cross-sectional width of about 0.16", and wall portion 97 a height of about 0.12". The centerline of rivet 33 and centerline of protrusion 88 are each about 0.832" along the diameter of closure structure 26 from its center.

An enlarged schematic view of a portion of can body 21 along with a similarly enlarged schematic view of a portion of the closure structure 26 are shown in juxtaposition in FIG. 13.

The stepped-flange of can body 21 presents side wall portion 59, intermediate ledge 60 and flange metal 62. Compound curvilinear transition zone 100 extends between ledge 60 and can body side wall 24 and presents a rounded convex edge oriented in the direction of central longitudinal axis 26.

The portion of closure structure 26 of FIG. 13, shown in juxtaposition (above and to the right of) the stepped flange of can body 21, is moved during can assembly such that its flange metal 84 overlays the flange metal 62 of the can body 20 providing flange metal for the double chime seam 30 of FIG. 1.

When thus assembled, scoreline 40 is contiguous to ledge 60. Trough 94 overlays ledge 60 with scoreline 40 at the radially outward portion (with respect to central axis 26) of the compound curvilinear transition zone 100.

The severed residual metal edge is shielded by placement of the scoreline 40 in the bottom of U-shaped trough 94. Consider the full-opening pull-out removed from panel 42. Because the scoreline 40 is in the bottom of trough 94, the severed residual metal edge (0.002" to about 0.0025" for steel) is not presented as a knife edge but, rather, only as a portion of a significantly thicker edge represented by the depth of trough 94. Only a minor portion of such thickened edge presents a severed metal edge. Protection for such minor edge portion on the throwaway panel pull-out is provided by selection of the depth of trough wall 101.

The severed residual metal edge which remains affixed to the can body after opening is additionally shielded. That is, in addition to thickened-edge, trough-wall protection, the rounded convex edge of can body 21 at transition zone 100 protects this severed residual metal edge.

Because of the curved transition zone 100, and the position of the severed scoreline metal contiguous to ledge 60, it is impossible to use such residual metal as a cutting edge. It is possible to sense by hand, on an opened can, that a scored metal edge is contiguous to ledge 60 and transition zone 100 but it would be difficult for a consumer or user to be scratched, let alone cut, by that edge.

Typically, double-reduced flat-rolled steel would be used for manufacture of can bodies for a baby food can. Both surfaces of such flat-rolled steel would include an organic coating. A TFS (tin-free steel) coating or other plating, selected for adherence of the organic coating, would be intermediate the steel base metal and outer organic coating.

The closure structure would typically be made from single-reduced flat-rolled steel. Flat-rolled aluminum could be used for the can body, closure, or tab opener.

Typical sheet metal gages are as follows:

| Part | Steel | Aluminum |
|---|---|---|
| can body | .005-.009" | .007-.012" |
| closure structure | .007-.009" | .008-.011" |
| tab opener | .011-.015" | .014-.020" |

The can body configuration of FIG. 14 enables an assembled can to roll, on its side, in a straight line. The purpose of this is to enable heat treatment of can contents, e.g. baby food, for either cooking or hygienic reasons, in conventional ovens. So-called "retorting" ovens convey baby food containers on their sides, which requires them to roll symmetrically about their central longitudinal axis.

The present invention provides a can body side wall configuration which provides for the chime seam at the open end of the can body to have substantially the same diameter as the main body portion of the can body side wall. In addition, the present invention avoids use of an abrupt necked-in or lip portion at the open end which would tend to inhibit discharge of contents or make access under such an abrupt necked-in or lip portion difficult.

Rather, a beveled side wall makes a smooth longitudinal transition from the main body side wall portion toward the open end of the can body. The desirable convenience and protection features, previously discussed, are maintained while further facilitating heat treatment of an assembled can in commercially available ovens.

Referring to the cross-sectional view of FIG. 14, a beveled side wall one-piece can body 104 is symmetrical about central longitudinal axis 105. Closed end wall 106 is unitary with cylindrical configuration main body side wall portion 107 and beveled side wall portion 108 which extends longitudinally toward the open end of the can body.

Stepped-flange rim 109 extends from a reduced-diameter cylindrical wall portion 110 and includes ledge 111, rim wall portion 112 and peripheral flange metal 114. Stepped-flange rim 109 serves the corresponding purposes, for adding an end closure structure and protecting severed scoreline metal, as described in relation to stepped-flange 22 of earlier figures. However, in forming a chime seam with can body flange metal 114 and flange metal 84 of closure 26, the outer diameter of the chime seam thus formed is substantially equal to the outer diameter of main body side wall portion 107.

The beveled side wall 108 of FIG. 14 is preferably fabricated by selecting tooling conforming to the desired configuration of side wall 108 and use of eccentrically-mounted side wall rolling apparatus of the type available from the Carnation Company, 5045 Wilshire Blvd., Los Angeles, Calif. 90036, or from Metal Box Engineering, Queens House, Forbury Road, Reading RG1 3JH, Great Britain; more conventionally, such apparatus is used for rolling reinforcing ribs into tubular side walls of sheet metal cans.

In fabricating the can body of FIG. 14, the final can body is redrawn to the diameter of main body side wall portion 107 with extra length flange metal oriented transversely to the central axis of the cylindrical side wall; such added length flange metal provides for pulling-in of flange metal into the side wall during eccentric rolling of the side wall.

Beveled side wall portion 108 is eccentrically rolled into the cylindrical wall portion above main body portion 107 starting at the juncture 115 between such wall portions and working toward such open end. After eccentric rolling of beveled side wall portion 108, stepped-flange rim 109 is formed, above reduced-diameter wall portion 110, from reduced-diameter side wall and flange metal at the open end of the can body.

The following dimensions are typical for a baby food can body of the configuration shown in FIG. 14:

| | Diameter | Height |
|---|---|---|
| Main body side wall 107 | 1.625" | .675" |
| Beveled side wall 108 (at reduced-diameter 110) | 1.25" | 1.0" |
| Wall portion 110 | 1.25" | 0.15" |
| Rim wall 112 | 1.52" | .083" |

Such wall heights do not include dimensions of compound curvilinear transition zones between horizontal and vertical portions of the can body; such radius dimensions are tabulated below:

| Transition Zone between | Approximate Radius |
|---|---|
| flange 114 and wall 112 | .06" |
| wall 112 and ledge 111 | .07" |
| ledge 111 and wall 110 | .03" |
| wall 110 and wall 108 | .09" |
| wall 108 and wall 107 | .10" |
| wall 107 and bottom 106 | .20" |
| Ledge 111 has a radial dimension of about | .27". |

The configuration of FIG. 14 could also be formed by removing flange metal after a draw-redraw process, by progressively necking-in the side wall above 115 to the reduced diameter of side wall portion 110, then forming the stepped-flange rim in necked-in metal remaining above the reduced-diameter wall 110.

While specific values relating to materials, dimensions, and geometric relationships have been set forth for purposes of describing the invention, other values could be adapted by those skilled in the art to the disclosed concepts in the light of the present teachings; therefore, for purposes of determining the scope of this invention, reference should be made to the accompanying claims.

I claim:

1. Method for forming an end closure structure for a can with an easy-open full-panel pull-out, protection features for severed edge metal and means securing an integral opener to such end structure comprising providing a sheet metal blank of predetermined diameter, shaping such blank to present a generally planar end wall panel longitudinally recessed from the plane of flange metal peripherally circumscribing such end wall panel, such end wall panel being symmetrically disposed in relation to its center which lies along the central longitudinal axis of an assembled can, such end wall panel being recessed in the direction of the interior of such assembled can, forming protrusion means spaced from such center about such end wall panel, such protrusion means extending outwardly with relation to an assembled can, forming unitary rivet button means for securing a tab opener to such end wall panel, forming a continuous groove in such end wall panel, such groove being U-shaped in radial cross section and circumscribing such end wall panel contiguous to such flange metal, such U-shaped configuration of such groove having its open end facing externally with relation to an assembled can with its closed end being recessed from and joined to such end wall panel by walls of such U-shaped trough, cutting a scoreline of reduced sheet metal thickness into the closed end of such U-shaped groove radially intermediate its walls, and securing an elongated tab opener to such structure with a unitary rivet formed from such rivet button, such tab opener having a longitudinal axis with a working end and a handle end at opposite ends of such axis, such tab opener being secured to such end closure structure with its longitudinal axis extending diametrically in relation to such end wall panel and with its working end disposed contiguous to a portion of such circumferentially continuous scoreline.

2. An easy-open sheet metal can providing improved can body access and shielding of edge metal severed during opening, comprising a one-piece sheet metal can body, a sheet metal closure structure, and an elongated tab opener made integral with such closure structure by rivet menas unitary with such sheet metal closure structure;

the one-piece sheet metal can body having closed end wall, a side wall, unitary with such closed end wall, extending in symmetrical relationship to the central longitudinal axis of the can body toward its remaining open end, and a rim of steppped configuration in radial cross section at the open end of the can body side wall extending both longitudinally of and radially outwardly in relation to such central longitudinal with a unitary compound-curvilinear transition zone intermediate such side wall and such stepped configuration rim, such transition zone presenting a convex rounded edge portion oriented radially inwardly toward such central longitudinal axis of the can body;

such stepped-flange rim of the can body including a ledge presenting a toroidal shape in plan view perpendicularly transverse to the central longitudinal axis of such can body, such ledge having its inner periphery joined to the can body side wall by such compound-curvilinear transistion zone and extending radially outwardly therefrom in relation to such central longitudinal axis toward its outer perphery, a longitudinally-directed wall extending in substantially parallel relationship to the central longitudinal axis from the outer periphery of such toroid-shaped ledge toward such can body flange metal for forming a chime seam at the open longitudinal end of such can body;

such closure structure including an end wall panel presenting a generally planar surface area in substantially perpendicularly transverse relationship to the central longitudinal axis of a can assembled from such can body and end closure, such planar surface area being in countersunk relationship to flange metal peripherally located on such closure structure, a continuous trough of substantially U-shaped configuration in radial cross section peripherally circumscribing such generally planar portion of the end wall panel, such U-shaped trough having its open end oriented toward the exterior of the can and its closed end disposed toward the interior of the can, such closed end of the U-shaped trough being in countersunk relationship to such generally planar surface area of such end wall panel and joined thereto by sides of such U-shaped trough, a continuous scoreline of reduced sheet metal thickness located within the closed end of such U-shaped trough radially between such trough sides, the sheet metal closure structure being positioned to close such open end of the one-piece can body and being joined to such can body by a chime seam, such chime seam being formed from flange metal disposed about the periphery of such closure structure and from such can body flange metal circumscribing such open end of the can body at the radially outward periphery of such stepped rim;

such U-shaped trough of such end wall structure being located radially to coincide with such toroidal-shaped ledge of the can body;

such scoreline providing residual metal circumscribing such end wall panel of the end clsoure structure such that severing the residual metal of the scoreline results in a full-open pull-out of such generally planar portion of such end wall panel presenting an opening with the severed residual metal edge which remains with such can being contiguous to and shielded by such convex rounded edge of such transition zone between such side wall and stepped rim of the can body, with at least a portion of such convex edge protion extending radially inwardly about such continuous scoreline residual metal severed edge toward such central longitudinal axis of the can body, and with severed metal on such full-panel pull-out being at least partially shielded by the side of such U-shaped trough remaining with such severed panel.

3. The sturcutre of claim 2 in which such can body side wall has a main body portion of uniform diameter extending over a major portion of the side wall height from such closed end wall toward such open end of the can body.

4. The structure of claim 3 in which such main body portion of the can body side wall has a uniform diameter extending from such can body closed end to the stepped-flange rim at the open end of the can body.

5. The structure of claim 3 in which such side wall presents a reduced diameter portion longitudinally intermediate such uniform-diameter main body portion and such stepped-flange rim of the can body, such reduced diameter side wall portion positioning such stepped-flange rim radially to enable such chime seam to present an outer diameter periphery substantially equal to the outer diameter periphery of such main body portion of the side wall.

6. The structure of claim 2 in which such elongated tab opener includes a handle end and a working end at its opposite longitudinal ends, and such rivet means securing such tab opener to the end wall panel orients the longtiudinal dimension of such tab opener diametrically in relation to such can body and such end wall panel with the working end of such opener disposed contiguous to such U-shaped, trough opening leading to such scoreline which circumscribes such end wall panel.

7. The structure of claim 2 in which such closure structure end wall panel includes a plurality of spaced protrusions distributed about such generally planar surface areas of such end wall panel exterior of the surface area occupied by such elongated tab opener in the plane of such end wall panel, such protrusions extending externally with relation to such can to establish a plane of support for a unitary closed end of a similar can to provide for stacking with central longitudinal axes of such cans being coextensive, such plane of support being transversely perpendicular to such central longitudinal axis and being located in longitudinally spaced relationship from such generally planar surface areas of the end wall panel to support such similar can without interference from such integral tab opener.

8. The structure of claim 7 in which such protrusions are disposed about such tab opened location to provide tripod support for such similar can.

9. The structure of claim 2 in which such one-piece can body closed wall has a generally planar configuration, and further including a plurality of nodules extending in an external direction with relation to the can body and distributed to support such can body with such generally planar configuration closed wall portion in spaced relationship from a planar support surface.

* * * * *

UNITED STATES PATENT AND TRADEMARK OFFICE

CERTIFICATE OF CORRECTION

PATENT NO. : 4,669,629

DATED : June 2, 1987

INVENTOR(S) : William T. Saunders

It is certified that error appears in the above-identified patent and that said Letters Patent are hereby corrected as shown below:

Column 5, line 9 "forced" should be --formed--.

Column 7, line 67, the sentence "Ledge 111 has a radial dimension of about .27"." is not a part of the tabulated data and is a continuation of the paragraph preceding the tabulated data.

Column 8, line 63, a new paragraph should be started beginning with the words "an elongated tab".

line 68, before "closed" insert --a--.

Column 9, lines 8-9, after "longitudinal" insert --axis--;

line 56, a new paragraph should be started beginning with the words "being formed from flange metal".

Column 10, line 3, "protion" should be --portion--;

line 10, "sturcutre" should be --structure--;

line 59, "opened" should be --opener--.

Signed and Sealed this

Twenty-fifth Day of August, 1987

*Attest:*

DONALD J. QUIGG

*Attesting Officer*

*Commissioner of Patents and Trademarks*